US010030907B2

(12) United States Patent
Kocaturk et al.

(10) Patent No.: US 10,030,907 B2
(45) Date of Patent: Jul. 24, 2018

(54) REFRIGERATOR COMPRISING A HUMIDITY-CONTROLLED CRISPER

(71) Applicant: ARCELIK ANONIM SIRKETI, Istanbul (TR)

(72) Inventors: Serdar Kocaturk, Istanbul (TR); Nihat Gunduz, Istanbul (TR); Tolga Apaydin, Istanbul (TR); Sabahattin Hocaoglu, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 207 days.

(21) Appl. No.: 14/890,149

(22) PCT Filed: Apr. 29, 2014

(86) PCT No.: PCT/EP2014/058636
§ 371 (c)(1),
(2) Date: Nov. 9, 2015

(87) PCT Pub. No.: WO2014/180700
PCT Pub. Date: Nov. 13, 2014

(65) Prior Publication Data

US 2016/0084569 A1 Mar. 24, 2016

(30) Foreign Application Priority Data

May 9, 2013 (TR) ..... a2013 05560

(51) Int. Cl.
*F25D 25/02* (2006.01)
*F25D 17/06* (2006.01)
*F25D 17/04* (2006.01)

(52) U.S. Cl.
CPC ..... *F25D 25/025* (2013.01); *F25D 17/042* (2013.01); *F25D 17/065* (2013.01);
(Continued)

(58) Field of Classification Search
CPC ..... F25D 17/065; F25D 25/025; F25D 2317/04131; F25D 2317/061; F25D 2317/063
See application file for complete search history.

(56) References Cited

U.S. PATENT DOCUMENTS 4,013,434 A 3/1977 Kronenberger et al.
4,557,118 A 12/1985 Pink et al.
(Continued)

FOREIGN PATENT DOCUMENTS

CN 101131276 A 2/2008
CN 102213520 A 10/2011
(Continued)

OTHER PUBLICATIONS

International Search Report of PCT/EP2014/058636 and references cited therein.
Written Opinion of PCT/EP2014/058636 and references cited therein.

*Primary Examiner* — Christopher R Zerphey
(74) *Attorney, Agent, or Firm* — Kilpatrick Townsend & Stockton LLP

(57) ABSTRACT

Refrigerator (1) comprising a body (2) wherein foods and beverages are placed, a crisper (3) disposed inside the body (2), at least one drawer (4) that is disposed into the crisper (3) and wherein fruits and vegetables are placed, a lower cover (5) that covers the upper side of the container (3), an upper cover (6) disposed over the lower cover (5) such that a gap remains therebetween, an air blowing opening (A) that is arranged on the body (2) and that enables cold air to be blown into the crisper (3), a separator (10) that prevents the air blown from the upper vent hole (8) and the lower vent hole (9) from being mixed together and a guiding member (11) that enables the air blown from the lower vent holes (9) to be directed towards the side walls of the crisper (3).

21 Claims, 3 Drawing Sheets

Figure 1:
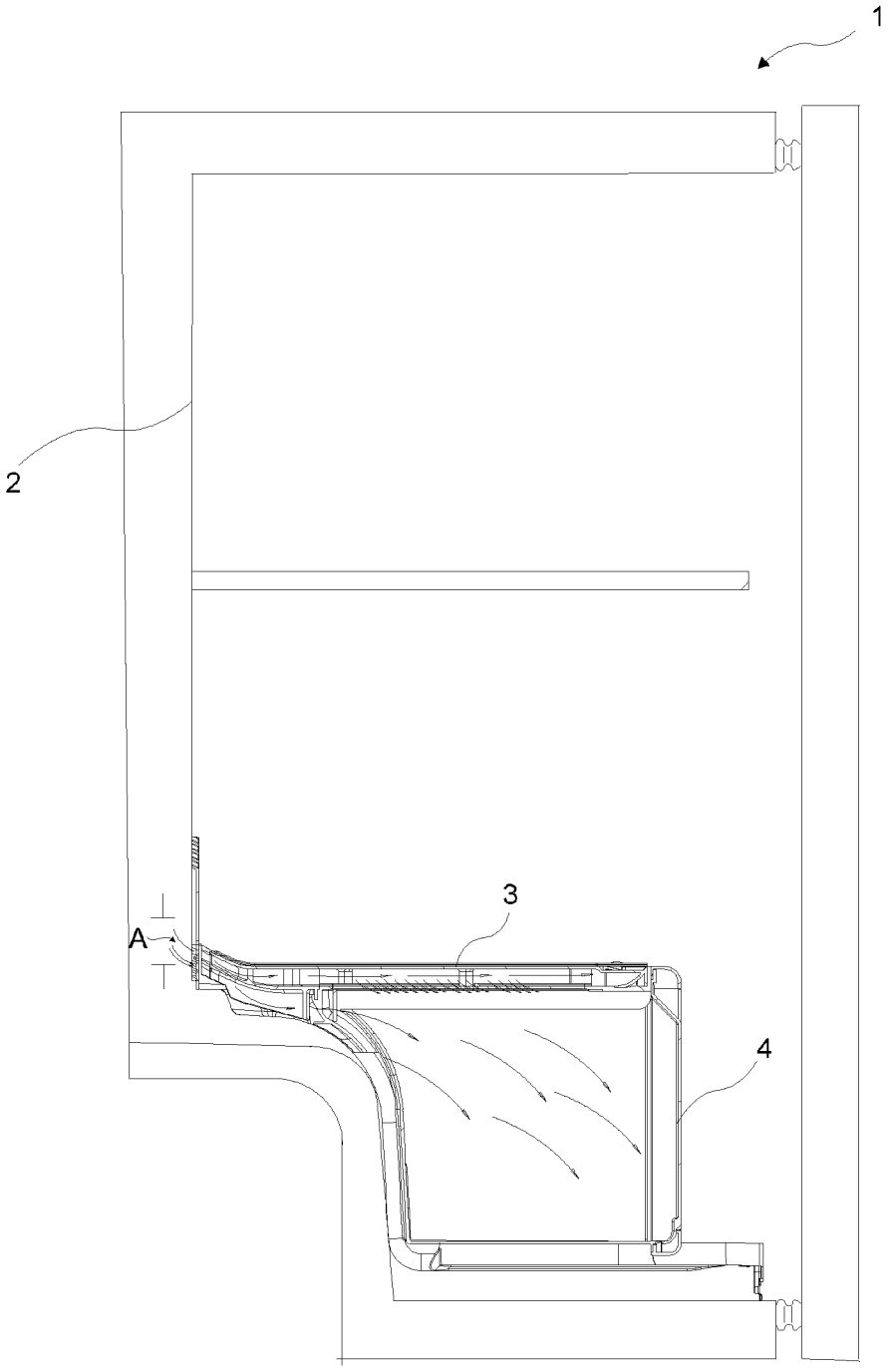

(52) U.S. Cl.
CPC ..... *F25D 2317/041* (2013.01); *F25D 2317/04131* (2013.01); *F25D 2317/061* (2013.01); *F25D 2317/063* (2013.01)

(56) References Cited

U.S. PATENT DOCUMENTS

| | | | | |
|---|---|---|---|---|
| 5,540,492 | A | 7/1996 | Dasher et al. | |
| 6,463,752 | B2 * | 10/2002 | Mandel | F25D 17/042 62/382 |
| 8,365,549 | B2 * | 2/2013 | Civanelli | F25D 17/042 62/176.6 |
| 2002/0104325 | A1 | 8/2002 | Mandel et al. | |
| 2006/0005567 | A1 | 1/2006 | Lee et al. | |
| 2012/0075074 | A1 | 3/2012 | Frosch et al. | |

FOREIGN PATENT DOCUMENTS

| | | | | |
|---|---|---|---|---|
| EP | 0719994 | A1 | 7/1996 | |
| GB | 2197444 | A | 5/1988 | |
| JP | H09113124 | A | 5/1997 | |
| JP | H11190584 | A | 7/1999 | |
| JP | 2013040717 | A | 2/2013 | |
| KR | 200179405 | Y1 | 5/2000 | |
| KR | 20040048776 | A | 6/2004 | |
| KR | 20050021069 | A | 3/2005 | |
| WO | 2004038312 | A1 | 5/2004 | |
| WO | 2010029041 | A1 | 3/2010 | |
| WO | WO 2010029041 | A1 * | 3/2010 | F25D 17/062 |

* cited by examiner

REFRIGERATOR COMPRISING A HUMIDITY-CONTROLLED CRISPER

The present invention relates to a refrigerator that comprises a crisper wherein humidity control is performed.

Refrigerators comprise a fresh food compartment wherein foods and beverages are stored, a freezer compartment that enables foods to be stored by being frozen, and a crisper that is disposed in the fresh food compartment wherein foods such as vegetables and fruits are stored. In order to prevent the foods placed in the crisper from dehydrating by sweating, the air flow between the crisper and the fresh food compartment is enabled to remain at a limited level. Accordingly, a temperature difference, although small, occurs between the crisper and the fresh food compartment interior volume. Depending on the temperature difference, sweating occurs on the surfaces that separate the fresh food compartment interior volume and the crisper. The sweating occurring on the surfaces of the crisper results in dripping of water on the foods stored in the crisper, and this causes the foods to spoil by adversely affecting storage lives of the foods.

Various methods are developed in the technique in order to prevent the formation of water drops by regulating the humidity balance of the crisper and to provide air movement in the crisper.

In the state of the art International Patent Application No. WO2004038312, an air supply unit introducing air into the crisper, a plurality of air ventilating holes situated on the crisper cover and the valves therein are described.

In the state of the art Japanese Patent Application No. JP9113124, a refrigerator is explained that has a crisper wherein humidity control is performed by controlling the air intake and exit.

In the state of the art Chinese Patent Application No CN101131276, a drawer type storage chamber is explained, the humidity balance of which is adjusted by the air intake and exit being controlled and by enabling the air to flow over the outer surface of the crisper or through it.

The aim of the present invention is the realization of a refrigerator wherein the amount of humidity in the crisper is controlled.

Another aim of the present invention is to prevent formation of condensation on the inner surface of the crisper cover due to the temperature difference between the interior volumes of the crisper and the refrigerator.

The refrigerator realized in order to attain the aim of the present invention, explicated in the first claim and the respective claims thereof, comprises an upper vent hole that enables the air flowing from the air blowing opening (A) to be blown between the lower cover and the upper cover, a plate comprising at least two lower vent holes remaining below the upper vent hole, a separator that extends from the level of the lower cover to between the upper vent holes and the lower vent holes and that prevents the air blown from the upper vent hole and the lower vent hole from being mixed together, and at least one guiding member that extends over the separator and that enables the air blown from the lower vent holes to be directed towards the side wall of the crisper.

In an embodiment of the present invention, the air blown from the lower vent holes per unit time is more than the air blown from the upper vent holes.

In an embodiment of the present invention, the plate comprises two lower vent holes, one that enables air to be delivered to one side wall of the crisper and the other to the other side wall of the crisper.

In an embodiment of the present invention, the plate comprises the lower vent hole and the upper vent hole having different cross-sectional areas, that enable the ratio of the amount of air delivered from the air blowing opening (A) in between the lower cover and the upper cover to be in the range of 1:4 to 1:1 with respect to the amount delivered to the side wall of the crisper per unit of time.

In an embodiment of the present invention, the refrigerator comprises at least one hole that is arranged on the lower cover and that enables the air passing over the lower cover to be partially delivered into the crisper and the lower surface of the lower cover to be swept, and at least one exhaust member that is arranged on the upper cover and that enables the ratio of the total outlet cross-sectional area to be in the range of 1:30 to 1:15 with respect to the total cross-sectional area of the holes arranged on the lower cover.

In an embodiment of the present invention, the refrigerator comprises at least one channel that is arranged on the separator, that remains between the lower cover and the upper cover, and that enables the air blown from the plate to be dispersed homogeneously between the lower cover and the upper cover.

In an embodiment of the present invention, the plate comprises an upper vent hole that supplies air to each channel.

In an embodiment of the present invention, the separator comprises the channels that are not identical.

In an embodiment of the present invention, the refrigerator comprises a valve that is disposed on the crisper, that closes 5% of the cross-sectional area of the air outlet opening in the closed position or opens the entire cross-sectional area of the air outlet opening so as to enable the air to be discharged therefrom.

In an embodiment of the present invention, the lower cover and the upper cover have chamfered corners that bear against the body. Thus, air is prevented from leaking from between the body and the surfaces of the lower cover and the upper cover contacting the body.

In an embodiment of the present invention, the guiding members bear against the body such that leak-proofing is provided between the body surface extending below the separator and the guiding members. Thus, the air blown from the lower vent hole is enabled to be delivered directly to the side walls of the crisper.

By means of the present invention, sweating is prevented from occurring on the surfaces of the crisper and the drawer, and foods stored in the crisper are prevented from being spoiled due to water dripping thereon, hence the storage lives of foods in the crisper are increased.

A refrigerator realized in order to attain the aim of the present invention is illustrated in the attached figures, where:

FIG. 1—is the schematic view of a refrigerator and a crisper therein.

Figure 2:
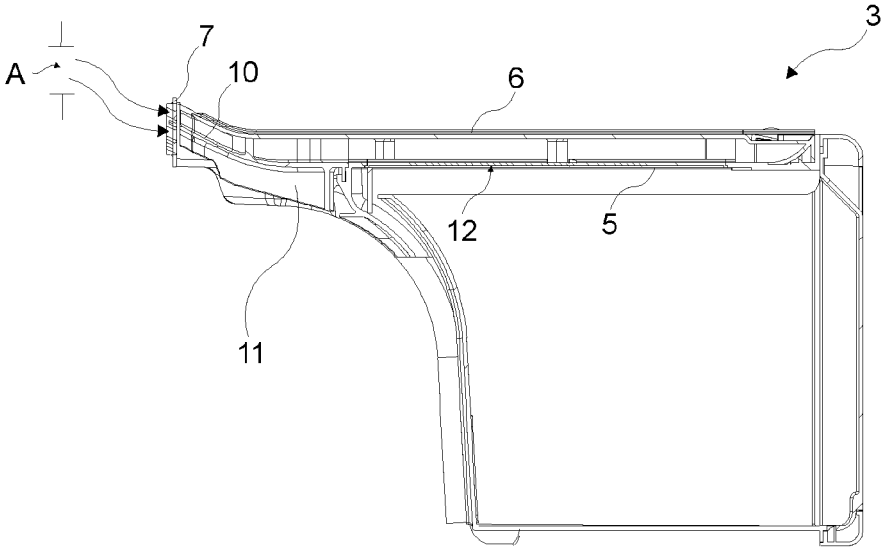

FIG. 2—is the detailed view of the crisper in an embodiment of the present invention.

Figure 3:
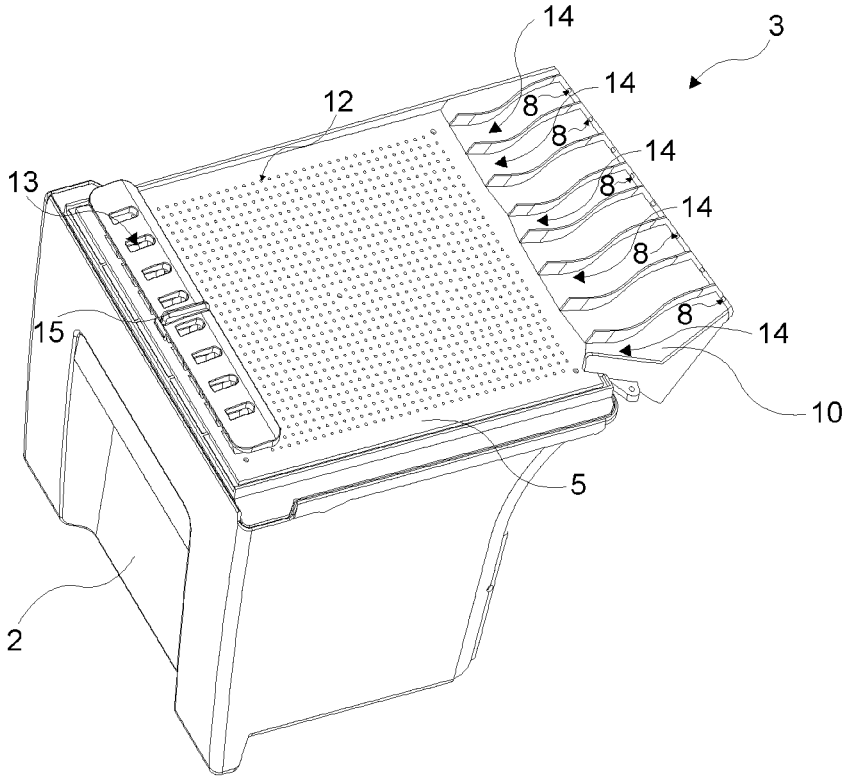

FIG. 3—is the perspective view of the crisper in an embodiment of the present invention.

Figure 4:
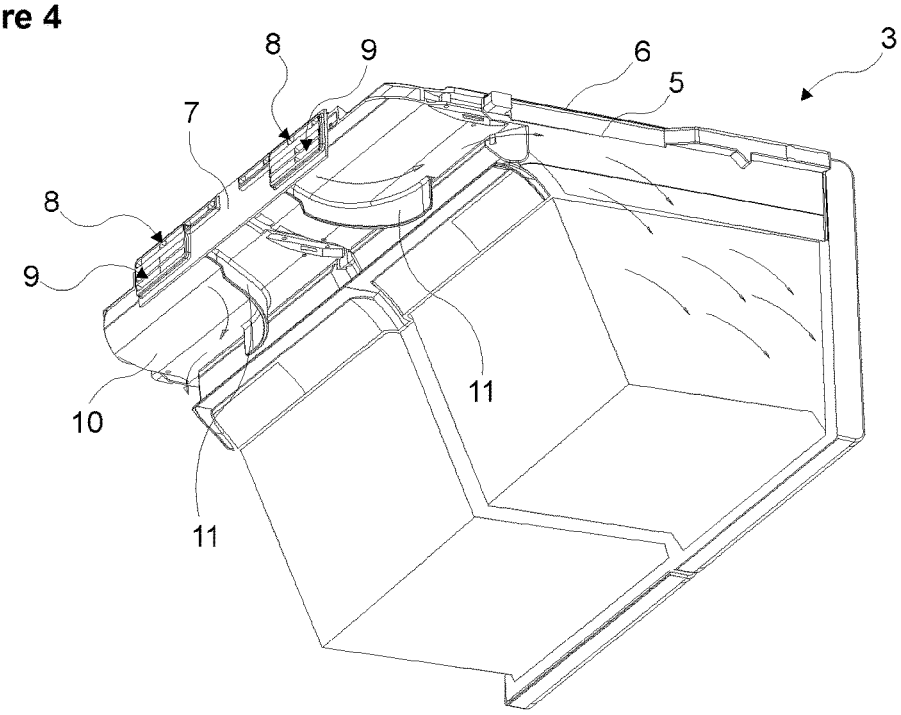

FIG. 4—is the perspective view of the crisper in an embodiment of the present invention.

Figure 5:
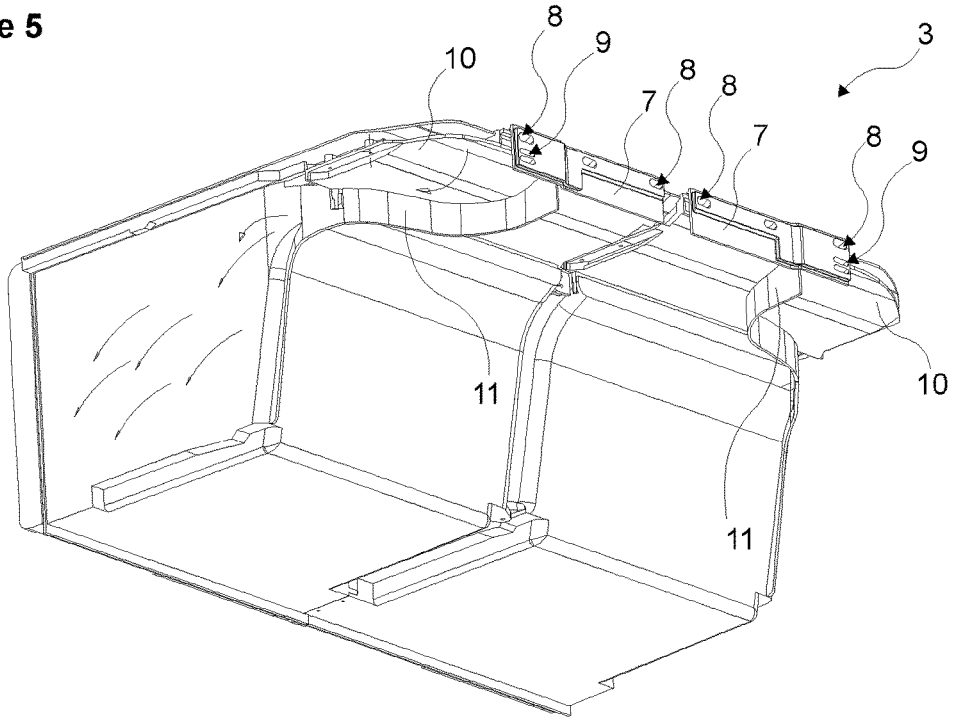

FIG. 5—is the perspective view of the crisper in an embodiment of the present invention.

The elements illustrated in the figures are numbered as follows:

1. Refrigerator
2. Body
3. Crisper
4. Drawer
5. Lower cover
6. Upper cover 7. Plate
8. Upper vent-hole
9. Lower vent-hole
10. Separator
11. Guiding member
12. Hole
13. Air outlet opening
14. Channel
15. Valve The refrigerator (1) comprises a body (2) wherein foods and beverages are placed, a crisper (3) disposed inside the body (2), at least one drawer (4) that is disposed into the crisper (3) wherein fruits and vegetables are placed, a lower cover (5) that covers the upper side of the crisper (3), an upper cover (6) that is disposed over the lower cover (5) such that a gap remains therebetween, an air blowing opening (A) that is arranged on the body (2) and that enables cold air to be blown into the crisper (3), and a plate (7) that is situated between the air blowing opening (A) and the crisper (3) and that enables the air flowing from the air blowing opening (A) to be directed to the crisper (3) (FIG. 1).

The refrigerator (1) furthermore comprises:

at least one upper vent hole (8) that is arranged at the upper side of the plate (7) and that enables air to be blown in between the lower cover (5) and the upper cover (6), at least two lower vent holes (9) arranged on the lower side of the plate (7), a separator (10) that extends from the level of the lower cover (5) to between the upper vent holes (8) and the lower vent holes (9) and that prevents the air blown from the upper vent hole (8) and the lower vent hole (9) from being mixed together, at least one guiding member (11) that extends from the lower side of the separator (10) towards the crisper (3) and that enables the air blown from the lower vent holes (9) to be directed towards the side walls of the crisper (3) (FIGS. 2, 3, 4 and 5).

The air blown from the upper vent holes (8) flows into the crisper (3) partially through the holes (12) arranged on the lower cover (5) so as to sweep the lower surface of the lower cover (5) while passing between the lower cover (5) and the upper cover (6). Thus, formation of condensation on the lower cover (5) is prevented. The air blown from the lower vent holes (9) is not delivered to the rear wall of the crisper (3) thanks to the guiding members (11) extending from below the separator (10), the temperature is balanced between the side walls, front walls and rear walls of the crisper (3), thus preventing over condensation and the crisper (3) rear wall from overcooling with respect to the side walls. Thus, formation of condensation at the rear wall of the crisper (3) and/or the drawer (4) is prevented and optimum humidity balance is provided inside the crisper (3).

In an embodiment of the present invention, the cross-sectional area of the lower vent hole (9) is larger than the cross-sectional area of the upper vent hole (8).

In an embodiment of the present invention, the refrigerator (1) comprises two lower vent holes (9) arranged near the right and left sides of the plate (7), one providing air delivery to the right side of the crisper (3) and the other to the left side of the crisper (3), and also two guiding members (11) that extend from the front of the lower vent holes (9) towards the side walls of the crisper (3). Thus, the air blown from each lower vent hole (9) is directed towards the side wall of the crisper (3) by means of the guiding member (11) disposed opposite the lower vent hole (9). The guiding members (11) extending from below the separator (10) contact the body (2) surface and enable the formation of an air flow path between the crisper (3) and the body (2).

In an embodiment of the present invention, the refrigerator (1) comprises the lower vent hole (9) and the upper vent hole (8) having different cross-sectional areas, enabling the ratio of the air amount delivered from the air blowing opening (A) in between the lower cover (5) and the upper cover (6) to be in the range of 1:4 to 1:1 with respect to the amount delivered to the side wall of the crisper (3) per unit of time. The total cross-sectional area of the lower vent holes (9) is greater than the total cross-sectional area of the upper vent holes (8), thereby enabling 50% to 80% of air flowing from the air blowing opening (A) to be delivered to the side walls of the crisper (3). Thus, the ideal temperature and relative humidity ratio enabling vegetables to be stored in the crisper (3) is provided.

In an embodiment of the present invention, the refrigerator (1) comprises more than one hole (12) that is arranged on the lower cover (5) and that enables the air flowing over the lower cover (5) to be partially delivered into the crisper (3) and the lower surface of the lower cover (5) to be swept, and at least one air outlet opening (13) that is arranged on the upper cover (6) and that enables one-thirtieth to one-fifteenth of the air volume passing through the holes (12) per unit of time to be delivered to the interior of the body (2).

In an embodiment of the present invention, the refrigerator (1) comprises more than one channel (14) that is arranged on the separator (10), that remains between the lower cover (5) and the upper cover (6) and that enables the air blown from the upper vent holes (8) on the plate (7) to be dispersed homogeneously between the lower cover (5) and the upper cover (6). Thus, the surface of the lower cover (5) is almost completely swept and regional condensations on the surface of the lower cover (5) are prevented.

In an embodiment of the present invention, the refrigerator (1) comprises an upper vent hole (8) that supplies air to each channel (14). Each channel (14) is supplied by a different upper vent hole (8). Thus, the air blown from the upper vent holes (8) is enabled to reach each channel (14). Consequently, air is dispersed more homogeneously between the lower cover (5) and the upper cover (6).

In an embodiment of the present invention, the refrigerator (1) comprises a valve (15) that is disposed in the vicinity of the air outlet opening (13) and that closes 5% of the cross-sectional area of the air outlet opening (13) in the closed position (C) when changed from the open position. The ideal condition for storing fruits and vegetables in the crisper (3) is at approximately 90% relative humidity. However, for some fruits and vegetables the said ideal condition is about 80% relative humidity. Therefore, a valve (15) is provided on the crisper (3) that at least partially closes and/or opens the cross-sectional area of the air outlet opening (13) so that the user can provide the ideal humidity rate depending on the type of the fruits and vegetables.

In an embodiment of the present invention, the separator (10) comprises the channels (14) that are configured differently from one another. The channels (14) with widening and/or narrowing shapes are not identical. Consequently, air is enabled to be dispersed more homogeneously between the lower cover (5) and the upper cover (6).

In an embodiment of the present invention, the lower cover (5) and the upper cover (6) have chamfered corners that contact the body (2). Thus, air is prevented from leaking from between the body (2) and the surfaces of the lower cover (5) and the upper cover (6) contacting the body (2).

In an embodiment of the present invention, the guiding members (11) contact the body (2) such that leak-proofing is provided between the body (2) surface extending below the separator (10) and the guiding members (11). Thus, the air blown from the lower vent holes (9) is enabled to be delivered directly towards the side walls of the crisper (3).

By means of the refrigerator (1) of the present invention, the humidity of the crisper (3) is effectively controlled. Formation of condensation on the surfaces of the crisper (3) and the drawer (4) is prevented.

The invention claimed is:

1. A refrigerator comprising:

a body configured to receive foods and beverages;

an air blowing opening arranged on the body;

a crisper disposed inside of the body, the crisper including:

a drawer configured to be disposed in the crisper, the drawer further configured to receive fruits and vegetables, the drawer having a top surface, a bottom surface, a first side wall, a second side wall, and a third side wall, wherein the first side wall is opposite of the third side wall, and wherein the second side wall extends between the first side wall and the third side wall;

a lower cover to cover the top surface of the drawer;

an upper cover disposed over the lower cover such that a gap remains between the upper cover and the lower cover;

a plate located between the air blowing opening and the drawer, the plate having an upper side and a lower side, the plate enabling air to be directed from the air blowing opening into the crisper, wherein the plate is on a side of the crisper with the second side wall when the drawer is disposed in the crisper, an upper vent hole disposed on the upper side of the plate, wherein the upper vent hole enables the air to be blown in between the lower cover and the upper cover, a plurality of lower vent holes arranged on the lower side of the plate, a separator extending from a level corresponding to the lower cover to between the upper vent hole and the plurality of lower vent holes, wherein the separator has a first end, a second end, a top surface, and a bottom surface, wherein the first end is opposite of the second end, wherein the first end is adjacent to the plate, wherein the second end is adjacent to the drawer when the drawer is disposed in the crisper, wherein the top surface of the separator is opposite of the bottom surface of the separator, wherein the first end extends between the top surface of the separator and the bottom surface of the separator, wherein the second end extends between the top surface of the separator and the bottom surface of the separator, and wherein the separator prevents the air blown from the upper vent hole from mixing with the air blown from a lower vent hole of the plurality of lower vent holes, and a guiding member extending along the bottom surface of the separator, the guiding member having a first end and a second end, the first end opposite of the second end, wherein the first end is adjacent to the plate, wherein the second end is adjacent to the drawer when the drawer is disposed in the crisper, and wherein the guiding member guides the air blown from a lower vent hole of the plurality of lower vent holes to the first side wall of the drawer.

2. The refrigerator as in claim 1, wherein a cross-sectional area of a lower vent hole of the plurality of lower vent holes is larger than a cross-sectional area of the upper vent hole.

3. The refrigerator as in claim 1, wherein a first lower vent hole of the plurality of lower vent holes is arranged near a right side of the plate, wherein a second lower vent hole of the plurality of lower vent holes is arranged near a left side of the plate, wherein the first lower vent hole provides air to a right side of the crisper, wherein the second lower vent hole provides air to a left side of the crisper, and wherein a plurality of guiding members extend from the front of the plurality of lower vent holes towards side walls of the crisper.

4. The refrigerator as in claim 1, wherein a lower vent hole of the plurality of lower vents holes has a different cross-sectional area from the upper vent hole, enabling a ratio of air delivered from the air blowing opening in between the lower cover and the upper cover to be in the range of 1:4 to 1:1 with respect to an amount delivered to the side wall of the crisper per unit of time.

5. The refrigerator as in claim 1, wherein a plurality of holes are arranged on the lower cover to enable air flowing over the lower cover to be partially delivered into the crisper and a lower surface of the lower cover to be swept, wherein an air outlet opening is arranged on the upper cover to enable one-thirtieth to one-fifteenth of a volume of the air passing through the holes per unit of time to be delivered to an interior of the body.

6. The refrigerator as in claim 1, wherein a plurality of channels are arranged on the separator, and wherein the plurality of channels enable the air blown from the upper vent holes on the plate to be dispersed homogeneously between the lower cover and the upper cover.

7. The refrigerator as in claim 6, wherein the plate includes a plurality of side-by-side upper vent holes that blow air to each channel of the plurality of channels.

8. The refrigerator as in claim 6, wherein each channel of the plurality of channels is configured differently from one another.

9. The refrigerator as in claim 5, wherein a valve is disposed in the vicinity of the air outlet opening, and wherein when changed from an open position to a closed position, the valve closes 5% of a cross-sectional area of the air outlet opening.

10. The refrigerator as in claim 1, wherein the lower cover and the upper cover each has chamfered corners that contact the body.

11. The refrigerator as in claim 1, wherein a plurality of guiding members contact the body such that leak-proofing is provided between a surface of the body extending below the separator and the plurality of guiding members.

12. The refrigerator as in claim 2, wherein the plurality of lower vent holes are arranged near a right side and a left side of the plate, wherein a first lower vent hole of the plurality of lower vent holes provides air to a right side of the crisper, wherein a second lower vent hole of the plurality of lower vent holes provide air to a left side of the crisper, and wherein a plurality of guiding members extend from a front of the plurality of lower vent holes toward side walls of the crisper.

13. The refrigerator as in claim 12, wherein a lower vent hole of the plurality of lower vent holes has a different cross-section area from the upper vent hole, enabling a ratio of the air delivered from the air blowing opening in between the lower cover and the upper cover to be in a range of 1:4 to 1:1 with respect to an amount delivered to a side wall of the crisper per unit of time.

14. The refrigerator as in claim 13, wherein a plurality of holes are arranged on the lower cover to enable air flowing over the lower cover to be partially delivered into the crisper and the lower surface of the lower cover to be swept, and wherein an air outlet opening is arranged on the upper cover to enable one-thirtieth to one-fifteenth of an air volume passing through the plurality of holes per unit of time to be delivered to an interior of the body.

15. The refrigerator as in claim 14, wherein a plurality of channels are arranged on the separator between the lower cover and the upper cover, and wherein the plurality of channels enable air blown from the plurality of upper vent holes to be dispersed homogeneously between the lower cover and the upper cover.

16. The refrigerator as in claim 15, wherein the plate includes a plurality of side-by-side upper vent holes that blow air to each channel of the plurality of channels.

17. The refrigerator as in claim 16, wherein each channel of the plurality of channels is configured differently from one another.

18. The refrigerator as in claim 17, wherein a valve is disposed in a vicinity of the air outlet opening, and wherein when changed from an open position to a closed position, the valve closes 5% of a cross-sectional area of the air outlet opening.

19. The refrigerator as in claim 18, wherein the lower cover and the upper cover each has chamfered corners that contact the body.

20. The refrigerator as in claim 19, wherein the plurality of guiding members contact the body such that leak-proofing is provided between a surface of the body extending below the separator and the plurality of guiding members.

21. A crisper for a refrigerator, the crisper comprising:

a drawer configured to be disposed in the crisper, the drawer having a top surface, a bottom surface, a first side wall, a second side wall, and a third side wall, wherein the first side wall is opposite of the third side wall, and wherein the second side wall extends between the first side wall and the third side wall;

a lower cover to cover the top surface of the drawer;

an upper cover disposed over the lower cover such that a gap remains between the upper cover and the lower cover;

a plate to receive air from outside of the crisper, the plate having an upper side and a lower side, the plate enabling the air to be directed into the crisper, wherein the plate is on a side of the crisper with the second side wall when the drawer is disposed in the crisper;

an upper vent hole disposed on the upper side of the plate, wherein the upper vent hole enables the air to be blown in between the lower cover and the upper cover;

a lower vent hole disposed on the lower side of the plate;

a separator extending from the plate to the lower cover, wherein the separator has a top surface and a bottom surface, wherein the top surface of the separator is opposite of the bottom surface of the separator, and wherein the separator prevents the air blown from the upper vent hole from mixing with the air blown from the lower vent hole; and a guiding member extending from the plate to the lower cover along the bottom surface of the separator, wherein the guiding member guides the air blown from the lower vent hole to the first side wall of the drawer.

* * * * *